US010040079B2

(12) United States Patent
Adams et al.

(10) Patent No.: US 10,040,079 B2
(45) **Date of Patent: *Aug. 7, 2018**

(54) TWO COMPONENT AIRLESS ADHESIVE SPRAY GUN AND METHOD OF USE

(71) Applicants: Steven E. Adams, Richmond, VA (US); John C. Hannon, Richmond, VA (US); Terry Nelson, Richmond, VA (US); Ian L. Churcher, Richmond, VA (US); Andrew T. Sinclair, Richmond, VA (US); Robert J. Rose, Richmond, VA (US)

(72) Inventors: Steven E. Adams, Richmond, VA (US); John C. Hannon, Richmond, VA (US); Terry Nelson, Richmond, VA (US); Ian L. Churcher, Richmond, VA (US); Andrew T. Sinclair, Richmond, VA (US); Robert J. Rose, Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/800,256

(22) Filed: Nov. 1, 2017

(65) Prior Publication Data

US 2018/0050352 A1 Feb. 22, 2018

Related U.S. Application Data

(63) Continuation of application No. 14/814,999, filed on Jul. 31, 2015, now Pat. No. 9,821,332.

(Continued)

(51) Int. Cl.

*B05B 7/08* (2006.01)
*B05B 7/12* (2006.01)

(Continued)

(52) U.S. Cl.

CPC ..... *B05B 7/0846* (2013.01); *B05B 1/306* (2013.01); *B05B 7/1209* (2013.01); *B05B 9/01* (2013.01); *B05B 12/002* (2013.01)

(58) Field of Classification Search

CPC ..... B05B 1/306; B05B 7/0846; B05B 7/1209; B05B 9/01; B05B 12/002

See application file for complete search history.

(56) References Cited

U.S. PATENT DOCUMENTS 2,458,220 A * 1/1949 Striegel ..... B05B 7/0846 239/305
3,302,891 A * 2/1967 Faro ..... B05B 7/1495 239/407

(Continued)

FOREIGN PATENT DOCUMENTS

DE 3336053 A1 * 4/1985 ..... B05B 7/0846
EP 0814139 12/1997

(Continued)

OTHER PUBLICATIONS

Industrial Hydraulic Spray Products, Spraying Systems Co., 2013, pp. A3 & C24.

(Continued)

*Primary Examiner* — Ryan A Reis
(74) *Attorney, Agent, or Firm* — Lambert & Associates; Gary E. Lambert; David J. Connaughton, Jr.

(57) ABSTRACT

A two part airless adhesive spray system is provided herein. This system provides numerous enhancements to the prior art including limiting overspray "fog," saving on sprayed material because of a more efficient spray pattern, and providing a stronger bond than that of the air-atomized spray guns of the prior art.

20 Claims, 4 Drawing Sheets

Related U.S. Application Data

(60) Provisional application No. 62/031,431, filed on Jul. 31, 2014.

(51) Int. Cl.

| | |
|---|---|
| ***B05B 12/00*** | (2018.01) |
| ***B05B 1/30*** | (2006.01) |
| ***B05B 9/01*** | (2006.01) |

(56) References Cited

U.S. PATENT DOCUMENTS

| | | | | | |
|---|---|---|---|---|---|
| 3,840,179 | A | * | 10/1974 | Krohn | B05B 7/0846 239/1 |
| 4,428,530 | A | * | 1/1984 | Chabria | B05B 7/0846 239/113 |
| 4,695,618 | A | | 9/1987 | Mowrer | |
| 4,928,884 | A | * | 5/1990 | Smith | B05B 7/0846 239/290 |
| 5,733,961 | A | | 3/1998 | Purvis | |
| 6,533,187 | B2 | | 3/2003 | May | |
| 7,216,816 | B2 | | 5/2007 | Hammarth | |
| 8,118,969 | B2 | | 2/2012 | Williams | |
| 2006/0069196 | A1 | | 3/2006 | Grabowski | |
| 2007/0224395 | A1 | | 9/2007 | Rowitsch | |
| 2007/0272768 | A1 | | 11/2007 | Williams | |

FOREIGN PATENT DOCUMENTS

| | | |
|---|---|---|
| WO | 2014182170 | 11/2014 |
| WO | 2015137808 | 9/2015 |

OTHER PUBLICATIONS

No. AA23L-458B5 & No. AA23L45885-SS, Gunjet Spray Guns, Spraying Systems Co., Sheet 1.

* cited by examiner

TWO COMPONENT AIRLESS ADHESIVE SPRAY GUN AND METHOD OF USE

BACKGROUND

When applying water based adhesives by hand spray techniques or automated/machine controlled spray techniques for assembly of cushioning materials, such as for the furniture and bedding industries, there is a problem with adhesive overspray. The overspray presents itself as a fog in the factory that can carry long distances from the actual application area of the factory. This fog also creates a nuisance dust health hazard for the employees. Lastly, the fog or overspray is wasteful of resources as the adhesive is lost and not used for its intended purpose. This overspray not only gets onto the employees that apply the adhesive, but also contaminates nearby equipment, finished product, or raw materials in inventory, and contaminates air conditioners, heaters, and lighting.

One solution has been to set up air extraction hoods in the spray area. This works relatively well when the filters are maintained and the types of parts that are being assembled are small. However when making larger items such as mattresses, large sofa cushions, and the like, the usefulness of an air extraction hoods is negated because of the impracticality of extraction hoods that are sized for large items.

Also there have been attempts to control the overspray fog by using low fogging air atomized guns such as the DUX or EasyFlow Laminair spray gun. Although these spray devices minimize the over spray when adjusted properly, they are dependent on the spray operators not adjusting the settings as they can easily be misadjusted and create fog.

Another solution has been to use different types of adhesive bases other than water base. Solvent based adhesives and hot melt adhesives when sprayed do not create a fog. These types of adhesives work well to eliminate the overspray but have other problems.

Solvent based adhesives contain hazardous materials and often are flammable. They require air extraction equipment to reduce the flammability hazard as well as the health hazards to employees. Also solvent adhesives do not adhere some types of visco-elastic foams.

Hot melt adhesives typically do not bond foam cushion substrates as well as water based or solvent based products. Hot melts also require melt tanks and heated hose and this equipment is more expensive on a per gun basis than water based or solvent adhesives.

Another solution is the roll coating of water based adhesive rather than spray application. Roll coating eliminates the over spray, but suffers additional problems because the rollers are exposed to the atmosphere. As such, during any down time at all, the adhesive on the rollers can coagulate, causing inconsistent application of the adhesive. In addition, at the end of a shift, the workers must clean the rollers, adding to the system downtime and taking away working time from the workers. Further still, rollers do not allow a control of the application rate over a surface. Although roll coating provides a consistent application of adhesive across an entire surface, sometimes it is advantageous to vary the application rate of the adhesive. For example, it may be advantageous to use more adhesive in one area, and less in another, thereby using less adhesive overall.

SUMMARY

The subject matter of this application may involve, in some cases, interrelated products, alternative solutions to a particular problem, and/or a plurality of different uses of a single system or article.

In one aspect, a two component airless adhesive spray gun system is provided. The system comprises a spray gun, an adhesive source connected to the gun, and an activator source connected to the gun. The spray gun may comprise a handle, with a trigger attached to the handle. The trigger controls a position of a first actuating needle, and a second actuating needle. Each of these needles is movable between a closed position and an open position and is biased in the closed position. The spray gun also has an adhesive inlet port and activator inlet port allowing connection between the adhesive source and activator source, respectively, to the spray gun. An adhesive nozzle for spraying of the adhesive may include an interior portion and the outer nozzle. The nozzle interior portion may include an inlet end, outlet end, and an interior. The interior may have an increased width portion, an orifice at the outlet end, and a needle seat configured to sealingly receive the first actuating needle when the first actuating needle is in the closed position. When the first actuating needle is in the open position, it may expose the orifice. The adhesive outer nozzle further may have a second orifice aligned with the orifice of the nozzle interior portion, the second orifice is at an exterior of the nozzle system. An activator housing is connected to the airless adhesive spray gun, and spaced apart from the adhesive nozzle. The second actuating needle is housed within a cavity formed by the activator housing. An activator nozzle is connected to the activator housing and is in communication with the cavity of the activator housing. The activator nozzle is configured to atomize a quantity of activator as it passes through an orifice of the activator nozzle. In varying embodiments, the system may be manual, as in held by hand during use, or mechanized and controlled by a computerized or other mechanical system.

DETAILED DESCRIPTION

Figure 1:
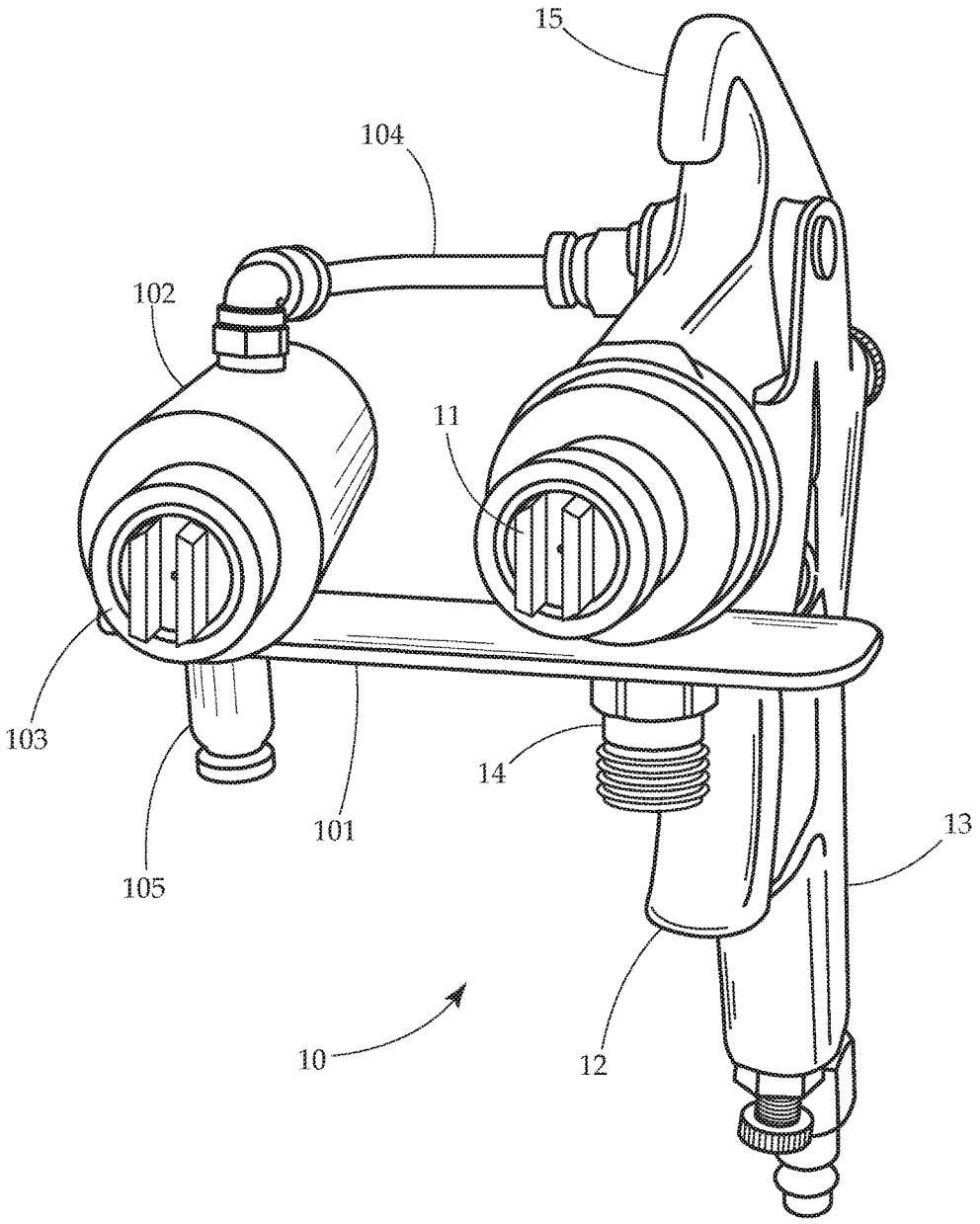
FIG. 1 provides a perspective view of an embodiment of the present invention.
Figure 2:
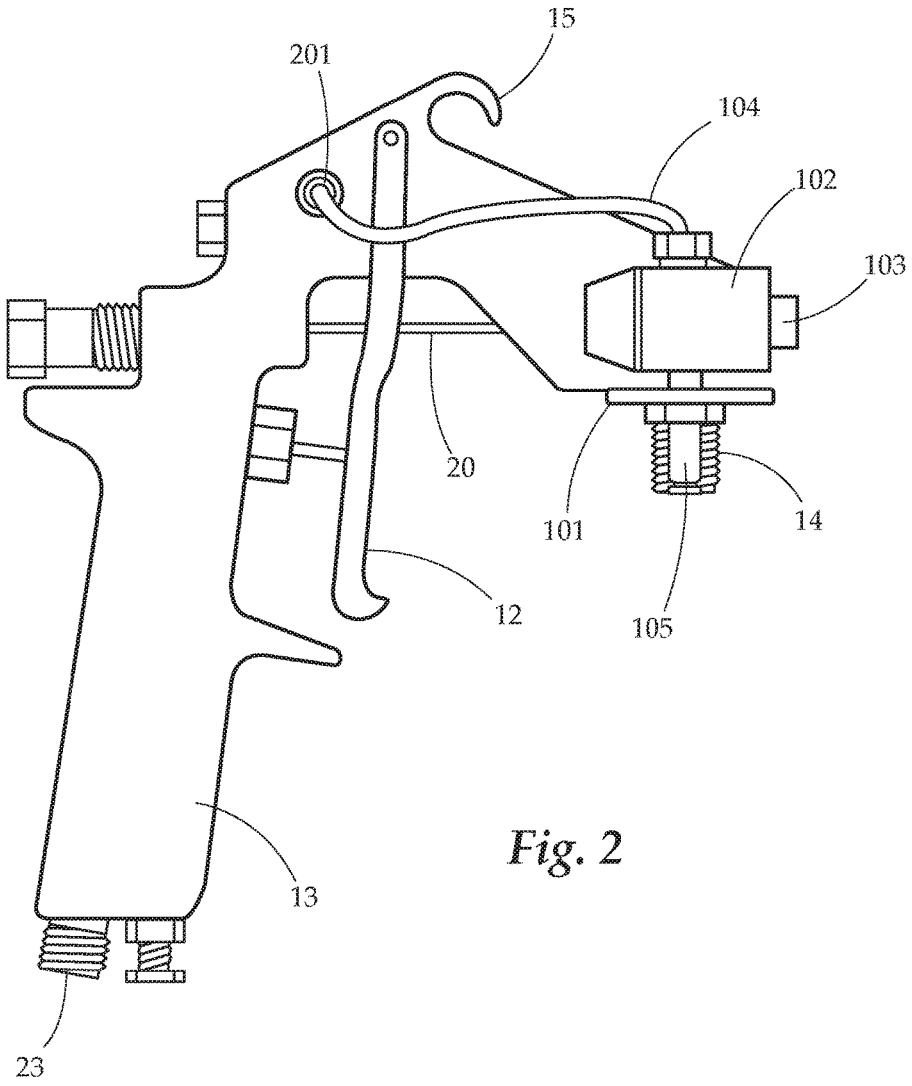
FIG. 2 provides a side view of another embodiment of the present invention.
Figure 3:
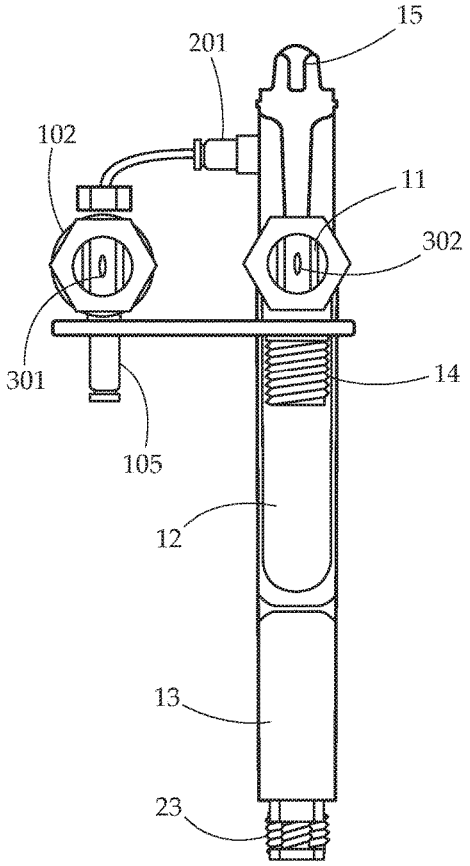
FIG. 3 provides a front view of yet another embodiment of the present invention.
Figure 4:
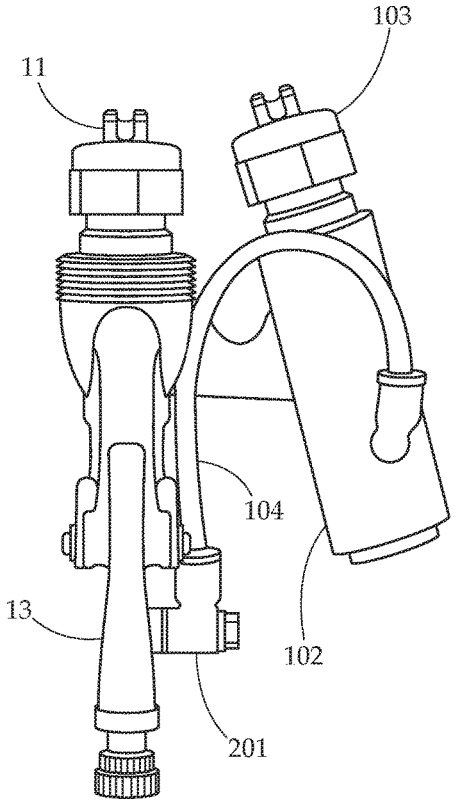
FIG. 4 provides a top view of still another embodiment of the present invention.
Figure 5:
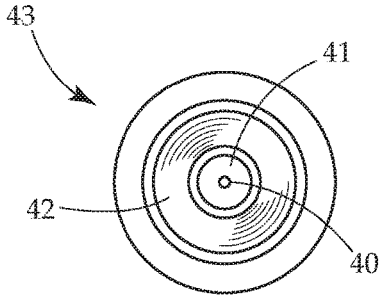
FIG. 5 provides an end view of an embodiment of the nozzle interior portion and orifice.
Figure 6:
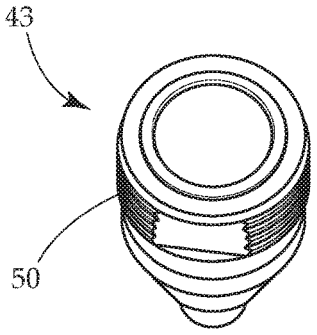
FIG. 6 provides a perspective view of an embodiment of the nozzle interior portion.

The present invention concerns a two part airless adhesive spray system.

In a one part airless spray application, the range of adhesive formulations that can be used is fairly narrow. This is due to the instability of the adhesives that provide instant tack capability (holding power) without air atomization, coupled with the stresses applied to the adhesives by spray guns. In a two part airless adhesive spray embodiment, contemplated herein, the range of adhesive formulations that will work are considerably larger. Particularly, any water based adhesive such as polychloroprene latex, or other lattices such as styrene butadiene rubber (SBR), Acrylic, Vinyl Acetate Ethylene(VAE), Poly-Vinyl Acetate (PVA), Vinyl Acrylic, Nitrile, Styrene Acrylic, Polyisoprene, Butyl Rubber, Guayule, and Natural Rubber that has a low viscosity can be sprayed using the two part airless system.

The present two part airless system consists of an airless spray gun that sprays adhesive through an atomizing nozzle without air assisted atomization. A separate spray head airlessly sprays an activator simultaneously through a second atomizing nozzle to mix with the water based adhesive after both are atomized and sprayed, giving the mixture instant tack or holding power.

As noted above, the present invention concerns a water based adhesive that can be applied by airless spray techniques. Generally it is the case for sprayed adhesives that the better an adhesive works to adhere, the worse it performs in a sprayed application. This is because the application of pressure, and the shear forces caused by forcing the adhesive through piping, spray gun internal flow paths, and a spray nozzle all cause the adhesive to coagulate and start acting as an adhesive as opposed to a fluid. The air atomized spray guns used in the prior art seek to limit the forces on the adhesive by using air atomization, and using low pressure feeds. An airless spray gun/system only magnifies the problems faced above: Airless spray guns and systems use higher pressure, have faster moving fluid (causing higher shear forces), and force the adhesive through a very small hole to cause it to atomize without the use of an air curtain or air stream. As such, airless spray guns are not considered to be an option in this field. The present invention unexpectedly overcomes these issues, using an airless spray gun with a specially designed adhesive to achieve airless spraying without the downfalls that would be expected, and further, resulting in a process that overcomes the issues of air atomized spray guns, namely overspray. Moreover, the effectiveness of the airless spray is enhanced by the use of an activator sprayed from a secondary nozzle.

The atomization of the adhesive and activator is caused when the adhesive is expelled through an airless gun tip that atomizes and spreads the adhesive into a controlled spray pattern. This is in contrast to an air atomized spray gun which atomizes the adhesive using an air stream or air curtain. The airless spray gun and adhesive sprayed through it eliminates the problem of overspray fog seen in the prior art.

In particular it has been observed that the present invention saves 30-40% compared to air atomized spray guns, in large part because of the elimination of this overspray. While typical airless spray guns operate using pressures of at least 300 psi, the present invention achieves airless spray at less than 150 psi. In a particular embodiment, the present invention achieves airless spray at approximately 30-60 psi. It has also been observed that bonding is faster and stronger with the present airless spray gun adhesive application than in the air atomized spray gun prior art. This may be because of larger droplets in the airless spray gun system, which penetrate further into the material to be bonded, giving a stronger bond at a lower adhesive application rate.

Typically the water based adhesives that are designed to work for foam fabricating embodiments tend to have reduced mechanical stability. This foam fabricating may be performed in an embodiment of the present invention as wet bonding, allowing more rapid assembly of the adhered components so that there is not a wait time between spraying and adhering, which there would be if the adhesive had to dry to be operational. This reduction in mechanical stability causes many water based adhesives to clog or coagulate when pumping or pressure pot delivering to spray guns. Also the small size of the airless spray nozzles causes the nozzles to clog and therefore not spray consistently or effectively. Further, the viscosities of current adhesives tend to be too high to atomize well using airless technology. They also tend to clog the nozzles of the airless gun as well as coagulate inside the airless gun due to the higher shear forces encountered during the airless spraying. As such, adhesives, particularly for foam adhesion are not used in airless spray applications. However, the adhesives used herein are mechanically stable enough to withstand the mechanical shear forces encountered with airless spraying, yet it has enough instability to still work in the application by providing instant grab or tack. This is especially true when mixed with the activator. Depending on adhesive selected, and spraying surface chosen, the activator becomes more essential. For example, when spraying highly porous surfaces, the activator becomes more vital because adhesion is more difficult.

However, it should be understood that this adhesive spray system may be used for many other product manufacturing processes including lamination adhesion processes, among others.

When using airless guns to deliver water based adhesive, the over spray fog is eliminated. Spray operators are not exposed to nuisance dust hazards. The factory, equipment, inventory, lighting and air handling systems, infrared heaters, and the like remain adhesive free. Further, airless spray guns are limited to have no adjustments that a spray operator can easily make to the spray device. This eliminates the problems associated with the adjustments that can be made with air atomized spray guns. Air atomized spray guns can have the following adjustments: atomization air, fan width air and fluid needle. Any changes in these adjustments can cause overspray fogging or over application of adhesive.

Current two part spray guns use air to atomize and mix the components outside of the spray nozzle. They either introduce the activator into an air cap, mixing the activator and air, and subsequently activator and adhesive spray after it is sprayed from the gun as controlled by the air/activator mixture coming from the air cap; or, a stream of atomized activator can be introduced into the air atomized adhesive stream after the air cap. Both of these methods cause the adhesive and activator to be over-sprayed or cause a fog that carries into the plant as described above. The current invention does not require air to atomize or mix the two components. The atomization is achieved using airless spray tips which are designed to work with very low pressure.

The present two part airless system seeks to eliminate the problem of over spray by not using air to atomize either the adhesive or the activator. Introduction of the activator into the adhesive is achieved by the specially designed angle of the spray heads which enables the adhesive and activator to meet after atomization through nozzles at a predetermined distance from the nozzle, thus allowing mixing while eliminating the adhesive overspray fog. In one embodiment, the mixing of the adhesive and activator may be in the air before reaching the surface to be sprayed. In another embodiment, the mixing of adhesive and activator may be on the surface being sprayed.

With this invention, the ratio of adhesive to activator may be about 25:1 and more preferably approximately 10:1 with the best results at approximately 5:1. However, the invention will work with a ratio range of 1:2 to 25:1. The various ratios are achieved entirely by nozzle orifice sizes and fluid pressure variations.

Generally, the activator contemplated herein may be any acid or salt solution or dispersion capable of activating the adhesive component, making it highly tacky and adherent. Examples of activators may include, but are not limited to: Acids such as: hydrochloric acid, phosphoric acid, sulfuric acid, nitric acid, boric acid, oxalic acid, acetic acid, citric acid, lactic acid, glycolic acid, propionic acid, glycine, alanine, valine, leucine, isoleucine, lycine; sulfate salts such as: zinc sulfate, potassium sulfate, sodium sulfate, magnesium sulfate, calcium sulfate, ammonium sulfate; nitrate salts such as: zinc nitrate, potassium nitrate, sodium nitrate, magnesium nitrate, calcium nitrate and ammonium nitrate; ammonium salts such as: ammonium nitrate, ammonium sulfate, ammonium chloride; chloride salts such as: zinc chloride, potassium chloride, sodium chloride, magnesium chloride, calcium chloride, and the like. These acids and salts are generally solvated in water at varying concentrations, typically at 30% or less. More typically in the range of 2 to 15%. In another embodiment, the activator may be a dispersion of sodium silicofluoride in water, or other similar dispersion.

In one embodiment, the adhesive selected and intended for use in the present invention is a water based dispersion with no co-solvents. The spray gun and particularly the adhesive nozzle therein is configured to carefully destabilize the selected adhesive dispersion so that it coagulates very quickly with shear forces from the spraying process. In many cases, this destabilization prevents similar adhesives from being used with an airless spray gun. However, the particular water based dispersion selected is resilient enough to maintain its flow properties under the shear forces of the spraying. Further, the water based dispersion adhesive selected and used herein in the airless spray gun has a low viscosity and is somewhat more stable to shear forces than other formulations known in the art. However, in one embodiment, the adhesive used herein may have enough instability to cause the emulsion to break quickly after spraying under the shear forces from the nozzle of the spray gun. This breaking may allow the adhesive to be able to adhere quickly and hold strongly enough for its applications. Such features are enhanced and/or made possible by mixing with the activator. In one embodiment, the adhesive may be used in foam fabrication such as that used in the furniture and bedding industries.

In a particular embodiment, the adhesive may be selected to be a polychloroprene latex base that can have other lattices such as styrene butadiene rubber (SBR), Acrylic, Vinyl Acetate Ethylene (VAE), Poly-Vinyl Acetate (PVA), Vinyl Acrylic, Nitrile, Styrene Acrylic, Polyisoprene, Butyl Rubber, Guayule, Natural rubber and the like added as well. A pH of the adhesive is lowered using Glycine, or other acid such as glycolic, lactic, citric, ascorbic, boric, and the like. Stabilizers are further added. The stabilizers may be any of: anionic soaps, nonionic surfactants, polymeric thickeners, and water. In a particular embodiment, the adhesive used herein may be SprayClean® 1404, Fabond, or equivalent from Worthen Industries. In another embodiment, the adhesive may be selected to have a SBR base. This SBR based adhesive may further have other lattices such as those listed above, as well as a polychloroprene latex. In still another embodiment, the adhesive may be selected to have a natural rubber latex base. This natural rubber latex based adhesive may further have other lattices such as those listed above, as well as a polychloroprene latex.

In one embodiment, the present invention may be entirely airless, in that both the adhesive and the activator are sprayed through an atomizing nozzle and without using air to atomize them. In this embodiment, a one part airless adhesive spray gun, such as that disclosed in U.S. patent application Ser. No. 14/626,352, incorporated herein by reference, has been provided with an added bracket that attaches another airless spray housing and nozzle onto the side of the gun. In another embodiment, the activator is supplied to a former air chamber inlet on an air atomized spray gun (for example, Agnest Iwata model W-71) that has been modified to provide airless spray. As such, the spray gun is modified to pass the activator through an air supply channel and chamber. The activator fluid is routed up through the gun handle and uses the former air valve that is triggered open by the trigger handle. The adhesive to be sprayed goes through the primary channel and chamber directly controlled by a needle connected to a trigger. When triggered, the activator then travels up through the gun and out a side port to the activator nozzle. The housing and nozzle is angled to allow the two materials to meet at a predetermined distance from the gun tip, typically from ½ inch to 18 inches, preferably 3 to 9 inches, more preferably 5 to 8 inches.

In another embodiment, the adhesive is atomized airlessly using an airless spray nozzle, while the activator is supplied to an air actuated needle seat valve. Compressed air is supplied to the gun as per its original design by the manufacturer (for example an Agnest Iwata W71 airspray gun that has been modified to be airless). When the trigger is pulled, the air valve is opened sending air to the activator needle seat valve. The needle is retracted by force from the air, allowing the activator to exit the nozzle. When the trigger is released the air flow is shut off and allowed to exhaust, releasing the pressure. The activator needle moves to its original position and rests in its seat cutting off the activator flow. Because the needle seat is at the nozzle, the shutoff is immediate and therefore the activator is stopped immediately and shuts off at essentially the same time as the adhesive. This design also uses airless atomization by spraying the activator through an atomizing nozzle. It should be understood that the compressed air used in this embodiment is solely for activation of the nozzle and not for atomization of the components.

In further embodiments, the two component airless spray gun may be replaced with a mechanized or automated spraying machine. In this embodiment, the spray device may be automated, as opposed to controlled by a person using a hand spray gun. In this embodiment, sensors such as optical, location, thermal, and the like, may control the activation of the spray nozzle, activating the spraying onto the desired surface. Robotic assembly may also be involved in these embodiments. Overspray may be a particularly important phenomenon to avoid for mechanized embodiments because the expensive machinery will be fouled by the adhesive cloud, jamming the machinery and otherwise leading to its wear and malfunction.

In another embodiment, the nozzle of the present invention may be configured to allow a metal needle of the spray gun to seat into a metallic seat of the nozzle. This allows the adhesive to be more closely controlled without being damaged or deformed during operation. While other materials may be used to seat the needle of the spray gun as long as the needle moved perpendicularly to the nozzle opening, metal has been seen to be superior, particularly over the life of the spray gun. However, in another embodiment, a plastic material may be used to form the entire interior nozzle, therefore the present invention is not limited to a metallic seat for the nozzle. Generally, the needle and seat may be configured in any manner to prevent leakage of a lower viscosity adhesive that is also capable of providing a clean seal when stopping the spraying process. As noted above, the prior art teaches that adhesives of the types described above cannot be used in airless spray gun applications because they are not stable enough to withstand the shearing forces of the spray gun without coagulating and jamming the spray gun. However, it has been unexpectedly observed that with a proper balance of adhesive properties, an airless spray gun may indeed be used with the right adhesive, proper nozzle sizing and spray gun configuration. In a particular embodiment, the nozzle may have an inner orifice and outer spray tip. This nozzle may have an outer spray tip orifice size of approximately 0.127 mm to 1.35 mm. In a further embodiment, the outer spray tip orifice size may be approximately 0.66 mm. The inner orifice may have an orifice size of 0.127 mm to 3.81 mm. In a further embodiment, the inner orifice may have an orifice size of 0.635 mm to 1.53 mm.

The unique design of the present invention is configured to allow a secondary spray nozzle to be mounted on the same spray gun and aligned to enable the activator to mix with the adhesive at a predetermined distance from the spray gun to avoid any fogging. This secondary spray nozzle is capable of limiting the volume of activator due the small orifice size and pressure. In the present embodiment, the activator nozzle may have an inner orifice and outer spray tip. This nozzle may have an outer spray tip orifice size of approximately 0.127 mm to 1.35 mm (0.005" to 0.053"). In a further embodiment, the inner orifice may have an orifice size of 0.635 mm to 1.53 mm (0.025" to 0.060").

Turning now to FIGS. 1, 2, 3, and 4, various views of an embodiment of the two-component airless adhesive spray gun are provided. The two component airless spray gun 10 ("spray gun") has a handle 13 providing structure to the body of the spray gun. A trigger 12 is movably positioned on the handle 13 and is biased by a spring assembly to a forward position, causing flow to be prevented through the orifices of nozzle 11 and 103. Upon depression of the trigger 12, an actuating needle 20 is pulled back, allowing flow from an adhesive source (not shown) through nozzle 11, namely nozzle orifice 302. In addition, upon depression of the trigger, flow of an activator from an activator source (not shown) is allowed through activator nozzle orifice 301. Flow through the activator nozzle orifice 301 may be achieved in a number of ways, as noted above, including a direct mechanical pull connected to the trigger 12, an air assisted needle actuation, and the like. In the embodiment shown, an air assist needle is used to control actuation and limit spilling of the activator by providing a rapid closing of the needle. As such, pressurized air may flow into the spray gun through the air inlet 23. This air is in communication with a needle assembly (not shown) of the activator spray housing 102 via connector 201 and line 104. The pressure change provided by the air line allows the needle assembly of the activator spray housing 102 to be very rapidly moved between an opened and closed position. Upon flow of the adhesive through nozzle 302 and activator flow through nozzle 301, both components are atomized. Their orientation (best seen in FIG. 4) towards each other causes the two components to mix, either in the air or on the substrate to be sprayed with adhesive. A hook 15 protrudes from a top of the handle 13. This hook 15 allows the spray gun 10 to be hung, or otherwise secured when not in use, or to be easily secured in place for fixed-use applications.

Also seen in these figures are the inlet ports for the activator 105 as well as the adhesive 14. These ports connect to the nozzles 103, 11, respectively and provide fluid communication to them. Activator spray housing 102 is held in place relative to the handle 13 and nozzle 11 by connector plate 101 (although it should be understood that any structure allowing the two nozzles, such as an integrated spray gun may be used without straying from the scope of the invention). This configuration allows a single component gun to be rapidly modified for two component airless spray operation. The connector plate also allows for adjustment of an orientation of the activator spray housing spray direction relative to a spray direction of the nozzle 11.

Figure 7:
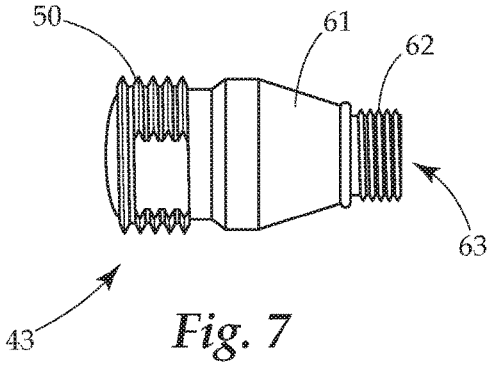
FIG. 7 provides a side view of an embodiment of the nozzle interior portion.
Figure 8:
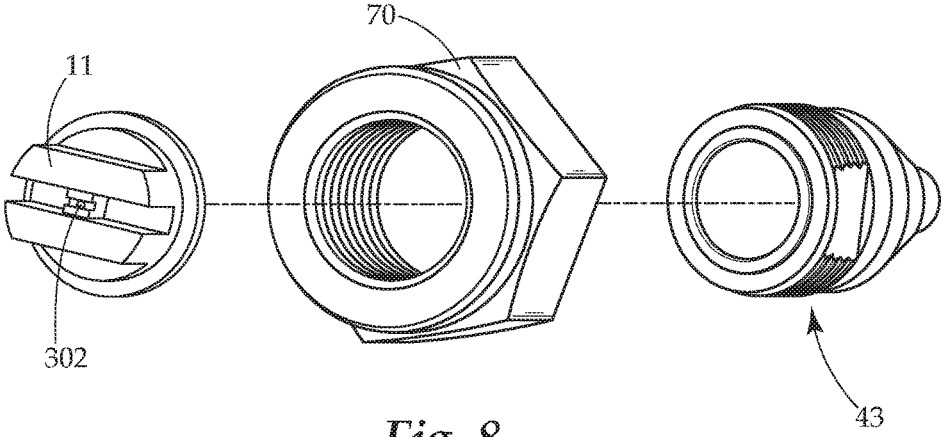
FIG. 8 provides a perspective exploded view of an embodiment of the nozzle assembly.

FIGS. 5, 6, 7, and 8 provide various views of the nozzle internal component. The nozzle internal component 43 forms an orifice 40 through which the airless adhesive of the two-component airless spray system is forced. It should be understood that in some embodiments, this structure is similar to the nozzle internal component of the activator spray housing 102 as well. While passing through this orifice 40, the adhesive passes to nozzle 11 and is atomized through orifice 302, and thus sprayed. A needle seat 41 allows the needle to flushly seat into the orifice and seat when the needle is in a closed position. Inner face 42 is formed to properly urge the adhesive fluid flow into and through the orifice 40 without excessive shearing. In some embodiment, inner face 42 may be coated with a low-friction coating. The nozzle interior component 43 has two threaded regions 50 and 62 which allow the nozzle to be secured in place to the spray gun 10. It should be understood, however, that any similar connection structure may be used in place of the threaded connections. As seen in FIG. 7 in particular, the inlet end 63 is narrower than the outlet end, and has an increased width portion 61 along its body. On an interior flow path of the inner nozzle 43, a fluid passage moving from inlet end 63 to outlet orifice 40 is a straight flow path, having an approximately consistent diameter. This consistent diameter flow path tapers inward immediately before the orifice 40. This tapering may form the nozzle seat, may be stepped, a portion of which is the nozzle seat, or other similar configuration. The configuration of the nozzle 11 and nozzle interior component 43 can be seen in FIG. 8, which shows the assembly in an exploded position. It should be understood, however, that the interior flow path is not limited to this straight path embodiment. It can be seen that a retaining nut 70 holds the nozzle 11 and nozzle interior component 43 together. However, it should be understood that any similar configuration may be used without straying from the scope of the present invention.

In summary, the present invention involves a combination of adhesive formulation and activator, with a unique spray gun to spray the two components using airless atomization, in order to come up with a unique invention. The problems of water based airless spray are numerous such as: problems with gun tip cleanliness, incompatibility with propellants, need for high solids for fast drying and the need for high pressure (typically above 300 psi to achieve atomization), valve seat leakages, clogging of spray gun internal chambers, and the like. The combination of adhesive selection with the modified two component gun embodiments have solved all of the problems with airless spray and has also solved the overspray issue seen in the air atomized spray guns for product assembly where adhesive is applied to one or both surfaces to be bonded and the parts are either immediately put together or are allowed to dry some period of time before assembly.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention and are inclusive, but not limited to, the following appended claims as set forth.

What is claimed is:

1. A two component airless adhesive spray gun comprising:

a trigger, the trigger controlling a position of a first actuating needle and a position of a second actuating needle, each needle movable between a closed position and an open position;

an adhesive inlet port;

an adhesive nozzle interior portion comprising an outlet end, and defining an orifice at the outlet end, the first actuating needle exposing the orifice when in the open position;

an activator housing spaced apart from an adhesive nozzle, the second actuating needle housed within the activator housing;

an activator nozzle in communication with a cavity of the activator housing; and wherein the spray gun is configured to atomize a quantity of adhesive at a pressure of less than 150 psi; and wherein the spray gun is configured to atomize a quantity of activator at a pressure of less than 150 psi.

2. The two component airless adhesive spray gun of claim 1 wherein the adhesive nozzle interior portion comprises an interior, the adhesive nozzle interior portion having an increased width portion along an outer body.

3. The two component airless adhesive spray gun of claim 1 further comprising an adhesive nozzle, the adhesive nozzle having a second orifice aligned with the orifice of the adhesive nozzle interior portion; and wherein the orifice of the adhesive nozzle has an outer size of approximately 0.127 mm to 1.35 mm.

4. The two component airless adhesive spray gun of claim 1 further comprising an adhesive nozzle, the adhesive nozzle having a second orifice aligned with the orifice of the adhesive nozzle interior portion; and wherein the orifice of the adhesive nozzle has an outer size of approximately 0.66 mm.

5. The two component airless adhesive spray gun of claim 1 wherein the adhesive nozzle interior portion further comprises a needle seat configured to sealingly receive the first actuating needle when the first actuating needle is in the closed position.

6. The two component airless adhesive spray gun of claim 1 wherein the second actuating needle is assisted in movement between the open and closed position by a pressurized air source.

7. The two component airless adhesive spray gun of claim 6 wherein a handle further comprises an air inlet, and a channel between the air inlet to a port;

an outlet line providing fluid communication between the port and the second actuating needle within the activator housing; and wherein upon a depression of the trigger, an air flow is configured to pass from the air inlet to the second actuating needle to move the second actuating needle to the open position allowing flow through the activator nozzle, and upon a release of the trigger, an air flow is prevented from the air inlet to the second actuating needle, causing the second actuating needle to move to the closed position.

8. The two component airless adhesive spray gun of claim 1 wherein the activator nozzle is angled towards the adhesive nozzle interior portion.

9. The two component airless adhesive spray gun of claim 1 wherein the activator nozzle is angled towards the adhesive nozzle interior portion to allow the two materials, when sprayed, to meet at a distance from the spray gun of between ½ inch to 18 inches.

10. The two component airless adhesive spray gun of claim 1 further comprising a low-friction coating applied to an inner face of the adhesive nozzle.

11. A two component airless adhesive spray gun system comprising:

an airless adhesive spray gun comprising:

a handle;

a trigger controlling a position of a first actuating needle, and controlling a position of a second actuating needle, each needle movable between a closed position and an open position;

an adhesive inlet port;

an adhesive nozzle interior portion in communication with the adhesive inlet port, and comprising an orifice at an outlet end, the first actuating needle exposing the orifice when in the open position;

an activator housing connected to the airless adhesive spray gun and spaced apart from an adhesive nozzle, the second actuating needle configured to expose an orifice of the activator housing when in the open position;

a quantity of adhesive connected to the airless adhesive spray gun through the adhesive inlet port, the quantity of adhesive being a water-based adhesive, a pressurizing structure providing the quantity of adhesive to the airless adhesive spray gun under the pressure of less than 150 psi;

a quantity of activator connected to the activator housing through an activator inlet port.

12. The two component airless adhesive spray gun system of claim 11 wherein the adhesive nozzle interior portion comprises an interior, the adhesive nozzle interior portion having an increased width portion along an outer body.

13. The two component airless adhesive spray gun system of claim 11 wherein the pressurizing structure provides the quantity of adhesive to the airless adhesive spray gun under pressure of between 30 and 60 psi, and wherein the spray gun is configured to atomize a quantity of adhesive when the adhesive is provided to the airless adhesive spray gun at the pressure of between 30 and 60 psi.

14. The two component airless adhesive spray gun system of claim 11 further comprising an adhesive nozzle, the adhesive nozzle having a second orifice aligned with the orifice of the adhesive nozzle interior portion; and wherein the orifice of the adhesive nozzle has an outer size of approximately 0.127 mm to 1.35 mm.

15. The two component airless adhesive spray gun system of claim 11 wherein the adhesive nozzle interior portion further comprises a needle seat configured to sealingly receive the first actuating needle when the first actuating needle is in the closed position.

16. The two component airless adhesive spray gun system of claim 11 wherein the second actuating needle is assisted in movement between the open and closed position by a pressurized air source.

17. The two component airless adhesive spray gun system of claim 16 wherein the handle further comprises an air inlet, and a channel between the air inlet to a port;

an outlet line providing fluid communication between the port and the second actuating needle within the activator housing; and wherein upon a depression of the trigger, an air flow is configured to pass from the air inlet to the second actuating needle to move the second actuating needle to the open position allowing flow through the activator nozzle, and upon a release of the trigger, an air flow is prevented from the air inlet to the second actuating needle, causing the second actuating needle to move to the closed position.

18. The two component airless adhesive spray gun system of claim 11 wherein the activator nozzle is angled towards the adhesive nozzle interior portion.

19. The two component airless adhesive spray gun system of claim 11 wherein the activator nozzle is angled towards the adhesive nozzle interior portion to allow the two materials, when sprayed, to meet at a distance from the spray gun of between ½ inch to 18 inches.

20. The two component airless adhesive spray gun system of claim 11 further comprising a low-friction coating applied to an inner face of the adhesive nozzle.

* * * * *